US006718663B1

(12) United States Patent
Geraghty

(10) Patent No.: US 6,718,663 B1
(45) Date of Patent: Apr. 13, 2004

(54) ASSEMBLY FOR COUPLING IMPLEMENTS TO EXCAVATING MACHINES

(75) Inventor: William F. Geraghty, Cumberland, MD (US)

(73) Assignee: Rockland, Inc., Bedford, PA (US)

( * ) Notice: Subject to any disclaimer, the term of this patent is extended or adjusted under 35 U.S.C. 154(b) by 0 days.

(21) Appl. No.: 10/252,447

(22) Filed: Sep. 24, 2002

(51) Int. Cl.[7] ..... E02F 3/32; E02F 3/96; F16B 7/06; F16B 21/00; F16G 11/12

(52) U.S. Cl. ..... 37/468; 37/443; 403/45; 403/48; 403/322.3

(58) Field of Search ..... 37/468, 443; 403/322.3, 403/374.3, 45, 48, 321, 322.1; 414/686, 680, 723

(56) References Cited

U.S. PATENT DOCUMENTS 3,988,004 A * 10/1976 Schosek ..... 254/29 R
4,872,264 A * 10/1989 LaBounty ..... 30/210
4,958,981 A * 9/1990 Uchihashi ..... 414/694
5,179,794 A * 1/1993 Ballinger ..... 37/468
5,975,604 A * 11/1999 Wolin et al. ..... 294/88
6,139,212 A * 10/2000 Heiple ..... 403/322.1
6,196,265 B1 * 3/2001 Horton et al. ..... 137/614

* cited by examiner

*Primary Examiner*—Christopher J. Novosad
(74) *Attorney, Agent, or Firm*—Stevens, Davis, Miller & Mosher, LLP

(57) ABSTRACT

A coupler assembly for detachably connecting an implement provided with a pair of mounting pins to a machine-having a dipper stick and at least one tilt link, generally consisting of a body pivotally connectable to such dipper stick and such pivot link, a first jaw portion engageable with one of the implement connecting pins and a pair of opposed guide slots; a jaw member mounted on the body and cooperable with the guide slots for displacement along a line of travel, engageable with the other of the implement connecting pins; and structure for displacing the jaw member along such line of travel.

20 Claims, 2 Drawing Sheets

ASSEMBLY FOR COUPLING IMPLEMENTS TO EXCAVATING MACHINES

BACKGROUND OF THE INVENTION

In the use of machines a dipper stick, an implement pivotally connected to the end of such dipper stick and a tilt assembly operatively interconnecting the dipper stick and the implement for tilting the implement about the axis of the connection of the implement to the dipper stick, it often is desirable to utilize different implements to perform different work functions and further to expeditiously detach and attach different implements. Typically, such implements are provided with a pair of spaced, parallel mounting pins. In the prior art, there are numerous types of devices mountable on the dipper stick and tilt links of such machines and detachably connectable to the mounting pins of such implements. It has been found, however, that many of such coupling devices are complicated in design, expensive to manufacture and difficult to maneuver in detaching one implement and attaching another implement. Accordingly, it is the principal object of the present invention to provide an improved assembly for expeditiously detaching and attaching different implements for performing different work functions on a machine provided with a dipper stick and a tilt assembly, which is simple in design, comparatively inexpensive to manufacture and easy to maneuver to detach and attach various implements.

SUMMARY OF THE INVENTION

The present invention provides an improved coupler for detachably connecting an implement provided with a pair of mounting pins on a machine having a dipper stick provided with a connecting pin and at least one tilt link provided with a connecting pin, generally consisting of a body having means for connecting the body to the dipper stick connecting pin and the tilt link connecting pin, a first jaw portion engageable with one of the implement mounting pins and a pair of opposed guide recesses; a jaw member mounted on such body and cooperable with the guide recesses for displacement along a line of travel, engageable with the other of the implement mounting pins; and means for selectively displacing such movable jaw member along such line of travel for engaging and disengaging such movable jaw relative with such other implement mounting pin. Preferably, one of the side walls of the implement mounting pin receiving recess of the displaceable jaw member is longer than the opposed side wall of such recess so that when the dipper stick of the machine is maneuvered to receive one of the mounting pins of the implement in the jaw portion of the coupler, and then the tilt assembly of the machine is operated to position the recess of the displaceable jaw in alignment with the other mounting pin of the implement, such longer side wall of the recess of the displaceable wall will engage such other mounting pin of the implement to facilitate such alignment.

DETAILED DESCRIPTION OF THE PREFERRED EMBODIMENT OF THE INVENTION

Figure 1:
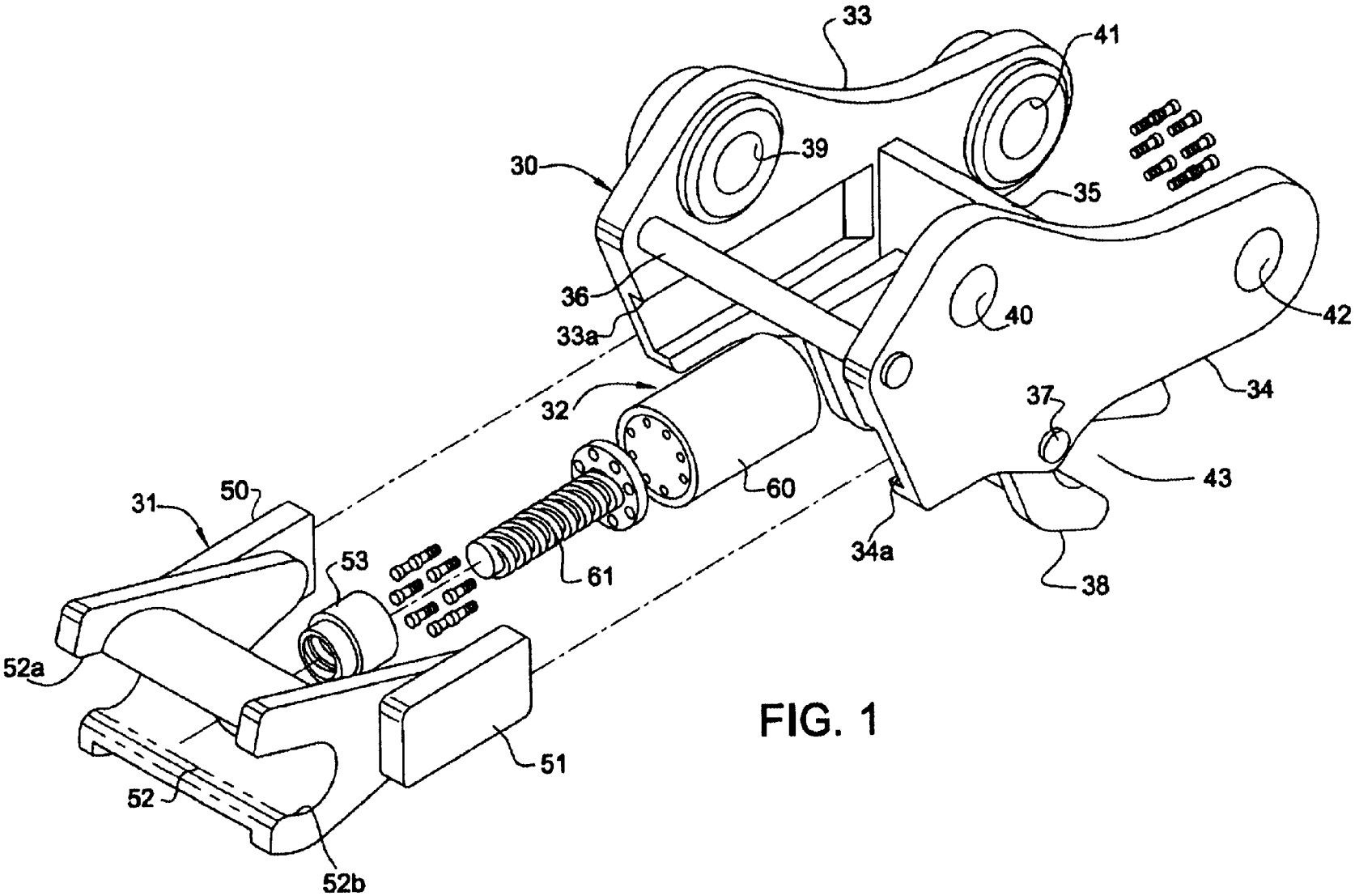
FIG. 1 is a perspective view of a coupler assembly mountable on the dipper stick and tilt assembly of a machine and detachably connectable to an implement, embodying the present invention, illustrating the components thereof in exploded relation.

Referring to the drawings, there is illustrated an implement 10, a dipper stick 11 of an excavating machine, a tilt assembly 12 of such machine and an assembly 13 mountable on such dipper stick and tilt assembly and detachably connected to such implement. Implement 10 consists of a bucket having a rear wall 14, a pair of longitudinally disposed, transversely spaced mounting brackets 15, 15 and a pair of longitudinally spaced, transversely disposed mounting pins 16 and 17 rigidly mounted on mounting brackets 15, 15. Dipper stick 11 is of a conventional construction including a connecting pin 18 mounted adjacent the free end thereof and a connecting pin 19 mounted a short distance from connecting pin 18. Tilt attachment 12 includes a pair of support links 20, 20, a pair of tilt links 21, 21 and a hydraulic cylinder assembly 22. Support links 20, 20 are substantially parallel and are connected at one set of ends to connecting pin 19 and are connected at the free ends thereof to a connecting pin 23. Tilt links 21, 21 are pivotally connected at one set of ends thereof to connecting pin 23 and are provided with a connecting pin 24 at the other set of ends thereof. Cylinder assembly 22 is provided with a cylinder member 25 pivotally connected at a base end thereof to a bracket mounted on an upper side of dipper stick 11 and a rod member 26 pivotally connected to connecting pin 23. Dipper stick 11 is pivotally connected at an upper end thereof-to a boom mounted on the main frame or platform of the machine and may be operated through the use of hydraulic cylinder assemblies to be extended and retracted and lifted and lowered. The tilt assembly also may be operated to tilt an implement about the axis of connecting pin 18 in the conventional manner.

Figure 2B:
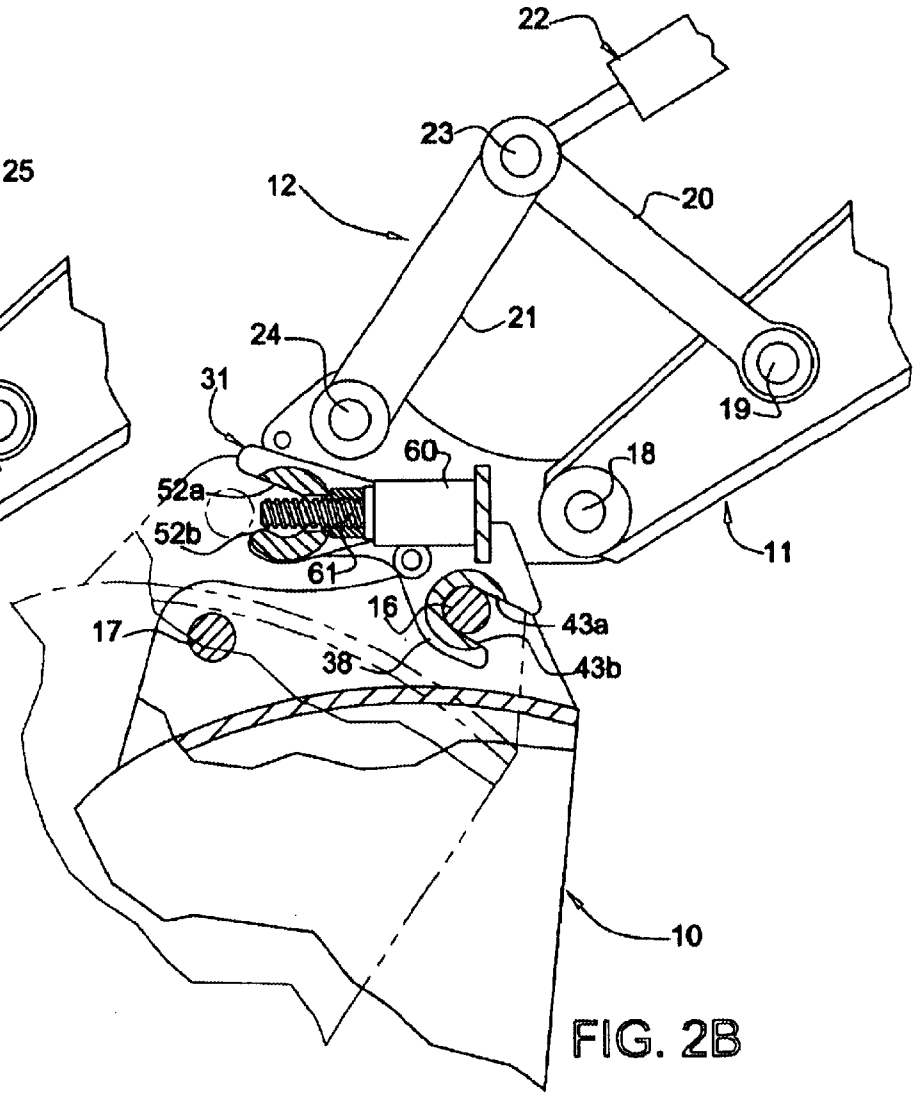
FIG. 2B is a view similar to the view shown in FIG. 2A, illustrating the coupler assembly partially detached from the implement.
Figure 2A:
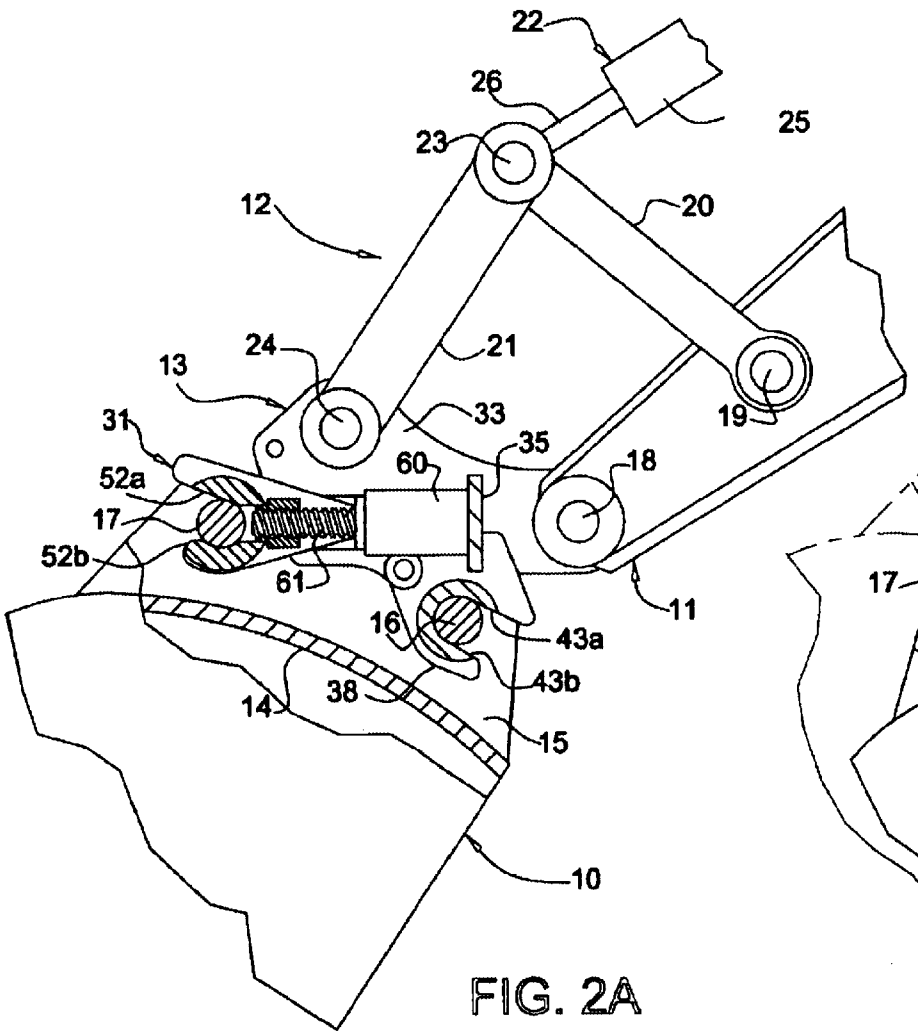
FIG. 2A is a side elevational view of the assembly shown in FIG. 1 mounted on the dipper stick and tilt assembly of a machine and utilized to pivotally connect an implement to the dipper stick of the machine, having portions thereof broken away.

Coupler assembly 13 includes a main body 30, a displaceable jaw 31 and a jaw displacement mechanism 32. Main body 30 consists of a pair of longitudinally disposed, transversely spaced plate members 33 and 34 rigidly interconnected by a transverse wall member 35 and a pair of rod members 36 and 37 and a jaw portion 38 depending from plate portions 33 and 34. As best seen in FIG. 1, the upper, forwardly disposed segments of plate portions 33 and 34 are provided with a pair of transversely aligned openings 39 and 40 adapted to receive connecting pin 24 of the tilt assembly therethrough to pivotally connect the front end of the coupler assembly to tilt links 21, 21, and a second set of transversely aligned openings 41 and 42 at the rearward segments thereof for pivotally connecting the coupler assembly to connecting pin 18 of the dipper stick. Jaw portion 38 includes a rearwardly opening recess 43 adapted to receive mounting pin 16 of implement 10 therein. As best seen in FIGS. 2A and 2B, an upper side wall 43*a* of recess 43 is longer than opposed side wall 43*b* thereof to facilitate the alignment of recess 43 with mounting pin 16 in seeking to engage the coupler assembly with mounting pin 16. Also, as best shown in FIG. 1, the inner surfaces of plate portions 33 and 34 are provided with parallel guide recesses 33*a* and 34*a* respectively.

Displaceable jaw 31 includes a pair of slide plate portions 50 and 51 which are receivable and displaceable along guide recesses 33*a* and 34*a* for displacing jaw 31 relative to main body portion 30 including jaw portion 38, along a line of travel, a forwardly opening pin receiving opening 52 and an internally threaded portion 53 having an axis disposed along the line of travel of jaw 31. Jaw 31 operates to engage mounting pins 17 of the implement and is provided with a recess having a side wall 52*a* longer than opposed wall 52*b* to allow jaw member 31 to be manipulated and positioned on mounting pin 17 to align recess 52 with mounting pin 17.

Displacement mechanism 32 consists of a rotary actuator having a base member 60 rigidly mounted on transverse wall portion 35 of the main body, and a threaded shaft 61 cooperable with internally threaded member 53 to cause jaw member 31 to displace relative to main body 30 and jaw portion 38 upon operation of the rotary actuator and rotation of shaft member 61. The axes of the rotary actuator and internally threaded member 53 and the longitudinal centerlines of guide slots 33*a* and 34*a* lie in the same plane including the line of travel of movable jaw member 31.

In the use of the coupler assembly as described, the rear end of the assembly may be mounted on the dipper stick by means of connecting pin 18 and the forward end of the assembly may be mounted on tilt links 21, 21 by means of connecting pin 24. To detachably connect implement 10 to the machine by means of the coupler assembly, the displacement mechanism 32 is first operated to retract movable jaw member 31 to a position as shown in FIG. 2B. The dipper stick is then maneuvered to cause mounting pin 16 to be received within recess 43 of jaw portion 38. Such engagement of mounting pin 38 is facilitated by positioning recess side wall 43*a* on mounting pin 16 and thus aligning recess 43 with the pin and allowing the coupler assembly to slide and receive mounting pin 16 in recess 43. With jaw portion 38 thus engaging connecting pin 16 as shown in FIG. 2B, the tilt assembly is operated to pivot the coupler assembly about the axis of mounting pin 16 and thus cause side wall 52*a* to engage mounting pin 17 and align connecting pin 17 with recess 52 of jaw member 31. With mounting pin 17 thus aligned, the rotary actuator is operated to extend jaw member 31 and thus receive mounting pin 17 in recess 52 of jaw member 31. The coupler assembly will thus be firmly secured to the implement, permitting the implement to be extended, retracted, lifted and lowered by means of the dipper stick and tilted about the axis of connecting pin 18 by the tilt assembly in the conventional manner to perform various work functions. To detach the implement from the machine, the dipper stick is first maneuvered to position the implement on the ground, the rotary actuator of the coupling assembly is operated to retract movable jaw member 31, the tilt assembly is operated to pivot the coupling assembly about the axis of mounting pin 16 and thus disengage the coupler assembly from mounting pin 17 and then the dipper stick is maneuvered to disengage the coupler assembly from mounting pin 16.

Although the embodiment described provides for the recesses in the jaw portion of the body and the displaceable jaw member opening outwardly for receiving the mounting pins of the implement, it should be understood that such recesses may be opposed or open inwardly. In addition, displacement mechanism 32 may comprise other motive means such as a fluid actuated rod and cylinder assembly.

The main body of the coupling assembly may be formed of components cut from steel plate and welded together. Guide slots 33*a* and 34*a* may be machined on the inner sides of plate portions 33 and 34 prior to assembly preferably by welding. Rotary actuator 32 may consist of any commercially available, hydraulically or electrically actuated device. Jaw portion 38 and displaceable jaw member 52 may be fabricated from steel plate or cast.

It will be appreciated that the coupler assembly as described is comparatively simple in design, relatively easy and inexpensive to manufacture, simple to mount on the dipper stick and tilt assembly of a machine and easy to operate for expeditiously attaching and detaching different implements. The simplicity of the design of the assembly further minimizes the load mountable on the free end of the dipper stick and thus enhances the payload of the machine.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A coupler assembly for detachably connecting an implement provided with a pair of mounting pins on a machine having a dipper stick provided with a connecting pin and at least one tilt link provided with a connecting pin comprising:

a body having a first and second means for connecting said body to said dipper stick connecting pin and said tilt link connecting pin, respectively, a first jaw portion engageable with one of said implement mounting pins and a pair of opposed guide slots;

a jaw member mounted on said body and cooperable with said guide slots for displacement along a line of travel, engageable with the other of said implement mounting pins; and means for selectively displacing said jaw member along said line of travel.

2. A coupler assembly according to claim 1 wherein said jaw portion and said jaw member are provided with outwardly opening recesses functional to receive said implement mounting pins.

3. A coupler according to claim 1 wherein said jaw portion and said jaw member are provided with opposed inwardly opening recesses operable to receive said implement mounting pins.

4. A coupler assembly according to claim 1 wherein said first and second means for connecting said coupler assembly to said machine comprise openings for receiving said connecting pins of said dipper stick and said tilt link.

5. A coupler assembly according to claim 1 wherein said displacing means comprises a rotary actuator mounted on said body, having a threaded shaft threaded into an internally threaded opening in said movable jaw member.

6. A coupler assembly according to claim 5 wherein said threaded shaft is disposed along said line of travel.

7. A coupler assembly according to claim 5 wherein said axis of said threaded shaft and longitudinal centerlines of said opposed guide slots lie in the same plane, along said line of travel.

8. A coupler assembly according to claim 5 wherein said rotary actuator is hydraulically actuated.

9. A coupler assembly according to claim 5 wherein said rotary actuator is electrically actuated.

10. A coupler assembly according to claim 1 wherein said body includes a pair of transversely spaced plate portions, and said opposed guide slots are disposed on inner sides thereof.

11. A coupler assembly according to claim 10 wherein said jaw portion and said jaw member are provided with outwardly opening recesses functional to receive said implement mounting pins.

12. A coupler assembly according to claim 10 wherein said jaw portion and said jaw member are provided with opposed, inwardly opening recesses operable to receive said implement mounting pins.

13. A coupler assembly according to claim 10 wherein said displacing means comprises a rotary actuator mounted on said body, having a threaded shaft threaded into an internally threaded opening in said displaceable jaw member.

14. A coupler assembly according to claim 13 wherein said threaded shaft is disposed along said line of travel.

15. A coupler assembly according to claim 10 wherein the axis of said threaded shaft and said opposed guide slots lie in the same plane, along said line of travel.

16. A coupler assembly according to claim 1 wherein said displaceable jaw member includes a mounting pin receiving recess, and including means for aligning said mounting pin with said recess when said one mounting pin of said implement is engaged by said jaw portion and said tilt link is operated to position said displaceable jaw member for receipt of said other mounting pin of said implement in the recess of said displaceable jaw member.

17. A coupler assembly according to claim 16 wherein said alignment means comprises a side wall of the recess of said displaceable jaw member being longer than an opposed side wall thereof.

18. A coupler assembly according to claim 1 wherein said jaw portion includes a recess for receiving one of said mounting pins of said implement therein, and including means for aligning said recess of said jaw portion with one of said mounting pins of said implement.

19. A coupler assembly according to claim 18 wherein said alignment means comprises a side wall of the recess of said jaw portion being longer than an opposed said wall thereof.

20. A coupler assembly according to claim 1 wherein said displacing means comprises a fluid actuated cylinder assembly.

* * * * *